US008847701B2

(12) United States Patent
Chun

(10) Patent No.: US 8,847,701 B2
(45) Date of Patent: Sep. 30, 2014

(54) MINIATURIZED DC BREAKER

(75) Inventor: Dong-Wan Chun, Incheon (KR)

(73) Assignee: Ace Technologies Corporation, Incheon (KR)

( * ) Notice: Subject to any disclaimer, the term of this patent is extended or adjusted under 35 U.S.C. 154(b) by 453 days.

(21) Appl. No.: 13/126,689

(22) PCT Filed: Oct. 29, 2009

(86) PCT No.: PCT/KR2009/006303

§ 371 (c)(1),
(2), (4) Date: Apr. 28, 2011

(87) PCT Pub. No.: WO2010/050760

PCT Pub. Date: May 6, 2010

(65) Prior Publication Data

US 2011/0205001 A1 Aug. 25, 2011

(30) Foreign Application Priority Data

Oct. 31, 2008 (KR) ..... 10-2008-0108131
Sep. 9, 2009 (KR) ..... 10-2009-0084972

(51) Int. Cl.

| | |
|---|---|
| ***H01P 9/00*** | (2006.01) |
| ***H01P 3/06*** | (2006.01) |
| ***H01R 24/42*** | (2011.01) |
| ***H01P 1/20*** | (2006.01) |
| *H01R 103/00* | (2006.01) |
| *H01P 1/04* | (2006.01) |
| *H01R 13/7197* | (2011.01) |

(52) U.S. Cl.

CPC ..... *H01P 1/2007* (2013.01); *H01R 2103/00* (2013.01); *H01P 1/04* (2013.01); *H01R 13/7197* (2013.01); *H01P 9/00* (2013.01); *H01R 24/42* (2013.01)

USPC ..... 333/160; 333/206; 333/245; 333/260

(58) Field of Classification Search

CPC ..... H01P 1/2007; H01P 9/00; H01P 1/04
USPC ..... 333/160, 206, 245, 81 B, 260
See application file for complete search history.

(56) References Cited

U.S. PATENT DOCUMENTS

| | | | | |
|---|---|---|---|---|
| 4,506,241 | A * | 3/1985 | Makimoto et al. | 333/222 |
| 6,255,917 | B1 * | 7/2001 | Scott | 333/202 |
| 7,355,495 | B2 * | 4/2008 | Lo Hine Tong et al. | 333/206 |
| 2010/0217262 | A1 * | 8/2010 | Stevenson et al. | 606/41 |

FOREIGN PATENT DOCUMENTS

| | | | |
|---|---|---|---|
| KR | 10-2002-0000093 | A | 1/2002 |
| KR | 10-2002-0029053 | A | 4/2002 |
| KR | 10-2004-0007230 | A | 1/2004 |
| KR | 10-2004-0036021 | A | 4/2004 |
| KR | 10-0742770 | B1 | 7/2007 |

* cited by examiner

*Primary Examiner* — Benny Lee
*Assistant Examiner* — Rakesh Patel
(74) *Attorney, Agent, or Firm* — Edwards Wildman Palmer LLP; Kongsik Kim; Stephen D. LeBarron

(57) ABSTRACT

A DC blocking device of a small size is disclosed. The disclosed DC blocking device may include: an internal conductor where RF signals are inputted; and an external conductor electrically connected to a ground; wherein the internal conductor has an insertion groove, and an insertion conductor is inserted into the insertion groove without touching the internal conductor and at a designated distance, and the diameter of the external conductor in the portion where the insertion conductor is inserted is set to be different from the diameter of another portion. The disclosed DC blocking device has the advantages of minimizing the spatial constraint when the DC blocking device is mounted on a mobile communication device, and of achieving suitable coupling even if the length of the part where coupling is achieved is reduced in the DC blocking device.

7 Claims, 9 Drawing Sheets

MINIATURIZED DC BREAKER

CROSS-REFERENCES TO RELATED APPLICATIONS

This application is a U.S. national phase application, pursuant to 35 U.S.C. 517 371, of PCT/KR2009/006303, filed Oct. 29, 2009, designating the United States, which claims priority to Korean Application No. 10-2008-0108131, filed Oct. 31, 2008, and Korean Application No. 10-2009-0084972, filed Sep. 9, 2009. The entire contents of the aforementioned patent applications are incorporated herein by this reference.

DISCLOSURE

Technical Field

The present invention relates to a DC blocking device, more particularly to a DC blocking device used in a mobile communication system such as a TMA (Tower Mounted Amplifier).

Background Art

When transmitting signals, a mobile communication base station system transmits signals to an antenna placed in a tower through a feeding cable after amplifying the signals that need to be transmitted at a high-output amplifier located in the base station, and the antenna placed in the tower radiates the transmission signals. Also, when receiving signals, a mobile communication base station system amplifies weak reception signals by transmitting them to a low noise amplifier inside the base station through a feeding cable after an antenna placed in the tower receives the signals.

In such a mobile communication base station system, a base station system and an antenna are generally placed apart at a substantial distance, thus having the problem of signals attenuating as transmission signals and reception signals are transmitted through feeding cables. If a base station system and an antenna are scores of meters apart, input signals may attenuate by 3 dB or more, and this may cause reception sensitivity to decrease due to a relative increase of noise during reception.

To resolve such problems, a transmission filter and an amplifier are included when an antenna and a base station are placed far apart, and the use of a TMA placed close to an antenna is becoming a basic requirement.

In such a TMA, RF signals and DC power signals are provided together, and there is a need to transmit RF signals and DC power signals separately. Of course, even in mobile communication equipment other than a TMA, such as a repeater, a device for separately transmitting RF signals and DC power signals in this manner is necessary.

Such a device is not necessary if cables for RF signals and DC power supply are equipped separately, but since doing so is difficult and costs much, a DC blocking device has been developed for separately transmitting RF signals and DC power signals through one cable.

A DC blocking device is a device for simultaneously receiving RF signals and DC power signals and either separating them or blocking the DC power signals, and such a DC blocking device and its circuit diagram are illustrated in FIGS. 1 to 3.

FIG. 1 is a drawing illustrating the circuit structure of an ordinary DC blocking device.

Referring to FIG. 1, in the operation of a DC blocking device, RF signals and DC power signals are inputted into terminal (a). Of the RF signals and the DC power signals, the DC power signals cannot pass through the capacitor C1, whereas the RF signals are output to terminal (b) through the capacitor.

Of the RF signals and the DC power signals, the RF signals cannot pass through the inductor, whereas the DC power signals are output to terminal (c) through the inductor L1.

In this manner, the DC blocking device may separate DC power signals and RF signals into different paths by a combination of an inductor and capacitor. Of course, a DC blocking device that blocks DC signals only without providing a separate path for DC signals may sometimes be used, and in such a case an inductor is not implemented.

FIGS. 2 and 3 are drawings illustrating a disassembled view and a cross-sectional view of a DC blocking device according to the prior art.

Referring to FIGS. 2 and 3, the conventional DC blocking device may include: a connector comprising an internal conductor 100, an external conductor 102, a housing 104 and a coupling plate 106; a junction groove 108 and an insertion groove 110 formed in the internal conductor 100, and an insertion conductor 112 inserted into the insertion groove 110.

RF signals are inputted to the internal conductor 100, and the external conductor 102 is electrically connected to a ground.

The internal conductor 100 has a junction groove 108 and an insertion groove 110. An inductor (not pictured) is electrically connected to the junction groove 108, and DC power signals are output through the inductor electrically connected at the junction groove 108.

Also, an insertion conductor 112 is inserted into the insertion groove 110. The insertion conductor 112 is not electrically connected to the internal conductor 100, and is inserted with a designated distance of space left between them. There forms capacitance between the internal conductor 100 and the insertion conductor 112, and coupling of RF signals is made to the insertion conductor, whereby the signals are output to the outside.

For proper coupling to be achieved between the internal conductor and the insertion conductor 112 in such a DC blocking device of the related art, the length of the section for achieving coupling (that is, the length of the insertion conductor) should be set at one quarter of the wavelength.

Consequently, the lower the frequency is, the longer the length of the section for achieving coupling gets, and in a low frequency band (850-900 MHz), as the length of the coupling section gets long, the size of a DC blocking device gets large, causing the problem of spatial constraint when mounted in a mobile communication device of a densified structure.

Technical Problem

To resolve the problems of the related art addressed above, an embodiment of the invention provides a DC blocking device that may be manufactured in a smaller size.

Another purpose of the present invention is to provide a DC blocking device that can minimize the spatial constraint when mounted to a mobile communication equipment.

Yet another purpose of the present invention is to provide a structure wherein proper coupling is achieved even if the length of the part of a DC blocking device where coupling is achieved is reduced.

Other purposes of the present invention can be derived through the embodiments below by those skilled in the related art.

Technical Solution

To achieve the objective above, an aspect of the invention provides a DC blocking device of a small size that includes: an internal conductor where RF signals are applied; and an external conductor electrically connected to a ground. The internal conductor has an insertion groove, and into this insertion groove is inserted an insertion conductor without touching the internal conductor and with a designated distance of space between them. The diameter of the external conductor in a portion where the insertion conductor is inserted is set differently from the diameter in another portion.

The diameter of the external conductor in the portion where the insertion conductor is inserted is set to be larger than in another portion.

A change in reactance in the portion where the diameter of the external conductor is set larger causes a decrease in an optimal coupling frequency.

Another aspect of the present invention provides a DC blocking device of a small size that includes: an internal conductor where RF signals are applied; and an external conductor electrically connected to a ground. The internal conductor has an insertion groove; an insertion conductor is inserted into the insertion groove without touching the internal conductor and with a designated distance of space between them; and the external conductor includes a high-impedance part having a relatively large diameter and a low-impedance part having a relatively small diameter.

Advantageous Effects

According to certain embodiments of the present invention, when a DC blocking device is mounted on a mobile communication device, spatial constraints can be minimized, and proper coupling can be achieved even if the length of the portion for achieving coupling in the DC blocking device is reduced.

MODE FOR INVENTION

A DC blocking device of a small size according to certain preferred embodiments of the invention will be described below in more detail with reference to the accompanying drawings.

Figure 1:
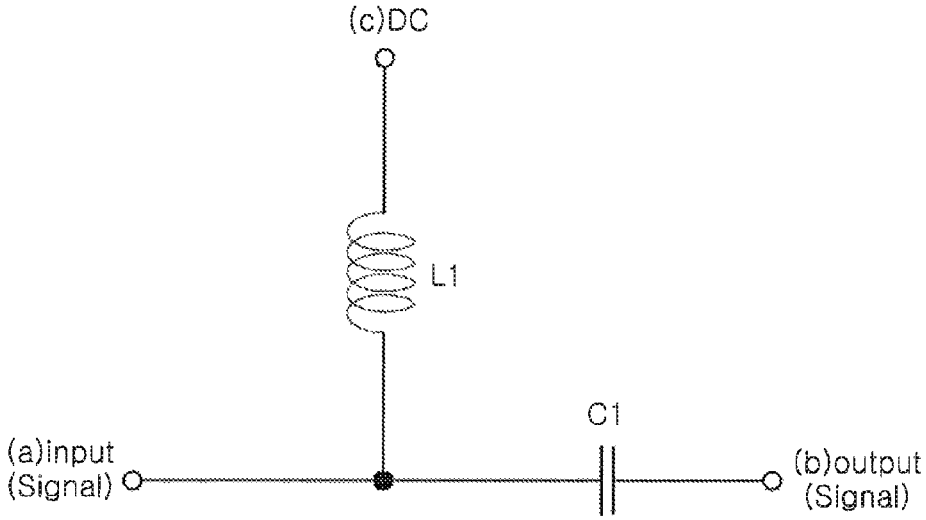
Figure 1 PRIOR ART
FIG. 1 is a drawing illustrating the circuit structure of an ordinary DC blocking device.
Figure 2:
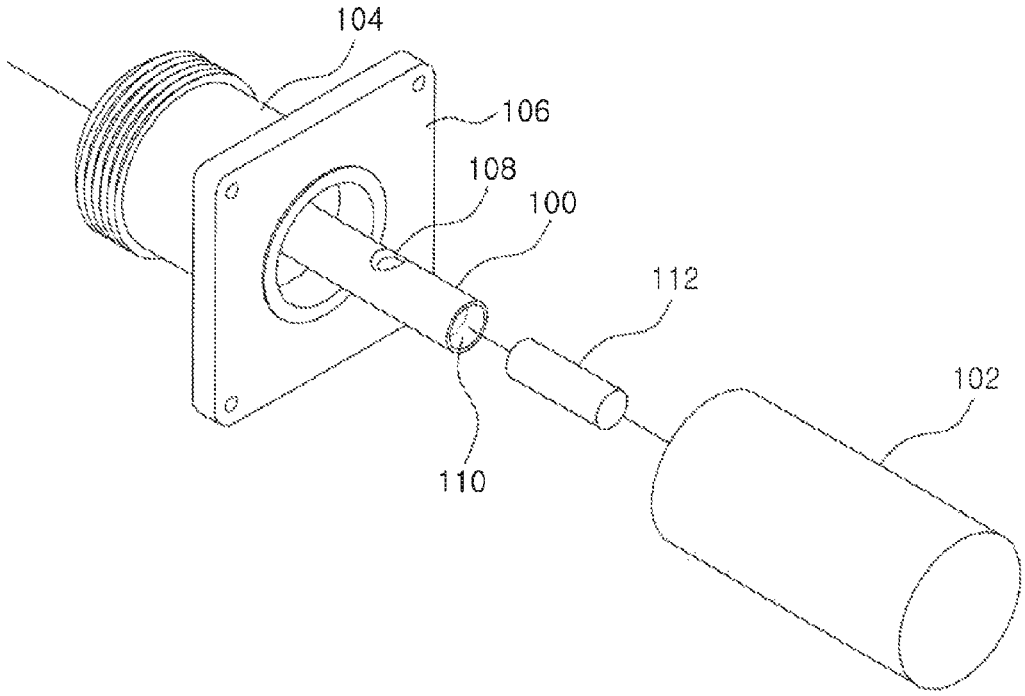
Figure 2 PRIOR ART
FIGS. 2 and 3 are an exploded perspective view and a cross-sectional view of a bias tee according to the prior art.
Figure 3:
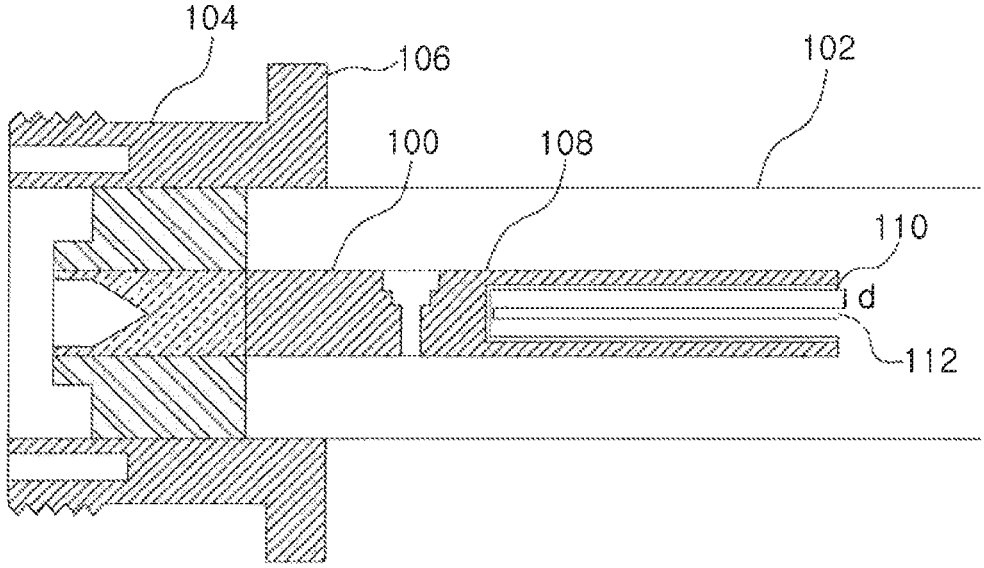
Figure 3 PRIOR ART
Figure 4:
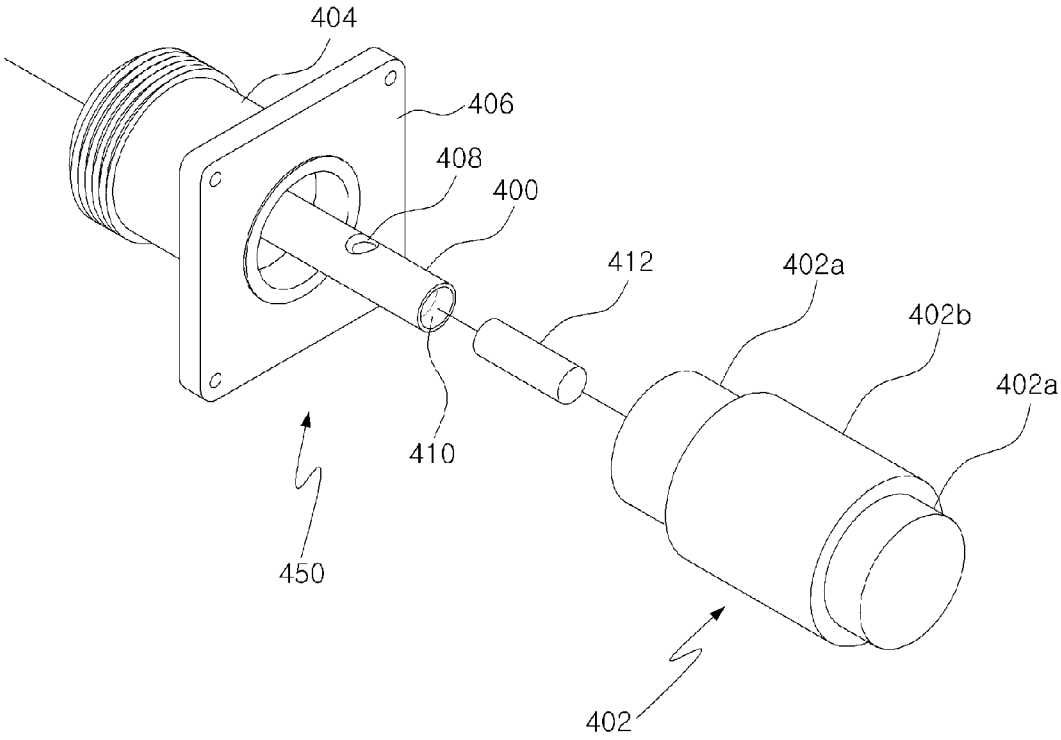
FIG. 4 is an exploded perspective view of a DC blocking device of a small size according to an embodiment of the present invention.
Figure 5:
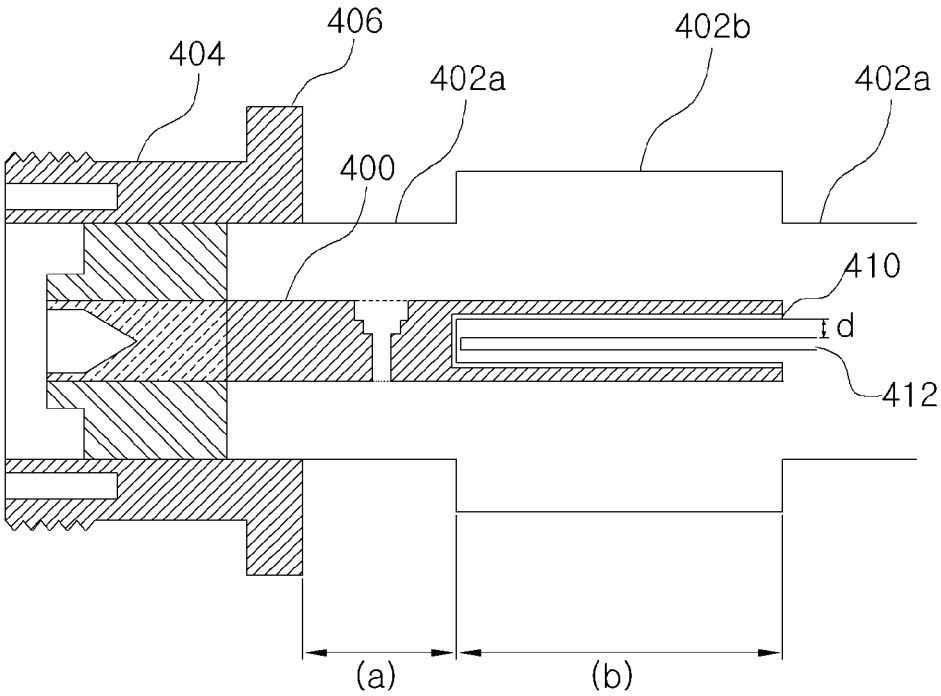
FIG. 5 is a cross-sectional view of a DC blocking device of a small size according to an embodiment of the present invention.

FIG. 4 is an exploded perspective view of a DC blocking device of a small size according to a first disclosed embodiment of the present invention, and FIG. 5 is a cross-sectional view of a DC blocking device of a small size according to the first disclosed embodiment of the present invention.

Referring to FIGS. 4 and 5, the DC blocking device according to the first disclosed embodiment of the present invention comprises: a connector 450, which includes an internal conductor 400, an external conductor 402, a connector housing 404, and a coupling board 406; and an insertion conductor 412. The internal conductor 400 has a junction groove 408 and an insertion groove 410, and the diameter of the external conductor 402 in the area where the insertion conductor is inserted is set to be larger than the diameter in other areas.

An RF cable is coupled to the connector unit 450, and RF signals and DC power signals are provided through the RF cable. As an example, the RF cable may be a coaxial cable. DC power signals are provided together with RF signals, for supplying power to a modem mounted on a TMA or a repeater or to other devices.

While FIG. 4 illustrates a case in which an internal conductor 400 for inputting signals is the internal conductor of the connector, it will be apparent to those skilled in the art that it may just as well be an internal conductor of an ordinary transmission cable, or any other internal conductor for applying RF signals from a variety of devices.

The internal conductor 400 and external conductor 402 of the connector 450 serve as a signal transmission path; RF signals and DC power signals are applied to the internal conductor 400, while the external conductor 402 provides ground potential. The internal conductor 400 and external conductor 402 may be cylindrical in shape.

An inductor (not shown) may be coupled to the junction groove 408 of the internal conductor. Of the DC power signals and RF signals inputted to the connector 450 through the RF cable, the DC power signals are output to the outside through the inductor coupled to the junction groove 408, providing DC power to devices such as modems.

Of course, DC blocking device according to the present invention may not include a junction groove 408. As described above, if there is no need for providing a separate path for DC power signals, a junction groove 408 is not formed in the DC blocking device and the DC blocking device of the present invention is not coupled to an inductor.

An insertion conductor 412 is inserted into the insertion groove 410 formed in the internal conductor. The insertion conductor 412 is electrically connected to an RF signal output end (not shown).

As illustrated in FIGS. 4 and 5, the insertion conductor 412 is inserted with a designated distance (d) between it and the internal conductor 400. The space (d) between the insertion conductor 412 and the internal conductor may be filled with a dielectric. Alternatively, an ordinary layer of air may perform the function of a dielectric. If a dielectric is to be filled in, a dielectric made of Teflon may be used.

An electromagnetic coupling occurs between the internal conductor 400 and the insertion conductor 412, and the RF signals applied at the internal conductor 400 are coupled from the internal conductor 400 to the insertion conductor 412 and outputted.

Referring to FIGS. 4 and 5, the external conductor 402 comprises a low-impedance part 402*a* and a high-impedance part 402*b*. The diameter of the external conductor 402 is set to be relatively smaller at the low-impedance part 402*a*, and relatively larger at the high-impedance part 402*b*.

As illustrated in FIGS. 4 and 5, in the portion (b) where coupling occurs between the internal conductor and the insertion conductor, the external conductor is implemented as a high-impedance part 402*b* with a relatively large diameter; and in the portion (a) where coupling does not occur between the internal conductor and the insertion conductor, the external conductor is implemented as a low-impedance part 402*b* with a relatively small diameter.

The reason for setting the diameter of the external conductor differently in this manner is for making the size of the DC blocking device smaller.

As described above, the length of the portion where coupling between the internal conductor and the insertion conductor occurs should be set as $\lambda/2$, that is, half of the central frequency wavelength $\lambda$. For example, if RF signals of 850 MHz-900 MHz band are used, the length of the portion where coupling occurs should be set at approximately 42 mm.

According to an embodiment of the present invention, the diameter of the low-impedance part may be set at 16 mm, and the diameter of the high-impedance part may be set at 26 mm.

As illustrated in FIGS. 4 and 5, if the external conductor electrically connected to a ground is divided into the low-impedance part 402*a* and the high-impedance part 402*b* having different diameters, the length of the part where coupling occurs may be set shorter than in the related art.

In the related art, the reason for setting the length of the area where coupling occurs at $\lambda/2$ is that the level of coupling is the highest when the length is $\lambda/2$. This is due to the fact that return loss in the conventional DC blocking device is the smallest at half the wavelength.

If the external conductor has a low-impedance part and a high-impedance part as in the present invention, the reactance changes at the high-impedance part, and it operates as a matching stub in an ordinary RF circuit.

Figure 6:
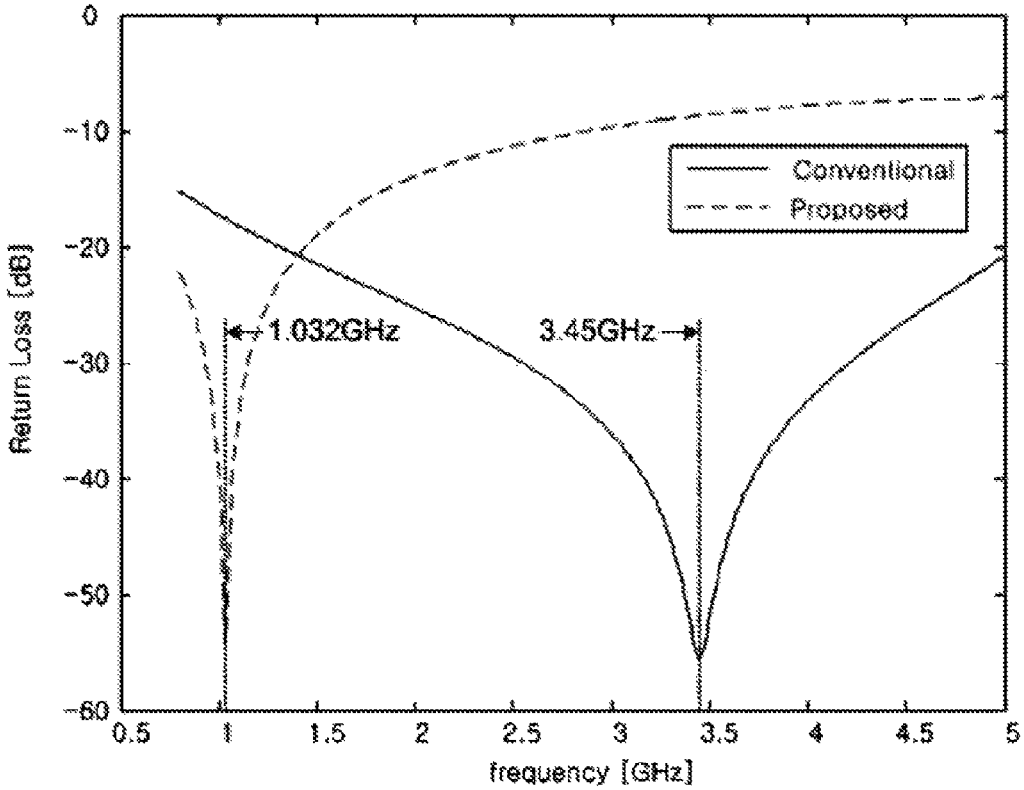
FIG. 6 is a drawing illustrating reactance curves obtained when a DC blocking device according to the related art is used and when a DC blocking device according to an embodiment of the present invention is used.

FIG. 6 is a drawing illustrating reactance curves obtained when a DC blocking device according to the related art is used and when a DC blocking device according to an embodiment of the present invention is used.

In FIG. 6, the solid line is a curve indicating return loss of a conventional DC blocking device having an external conductor of a consistent diameter, and the dotted line is a curve indicating return loss of a DC blocking device having an external conductor with a relatively large diameter in the portion where coupling occurs, according to the present invention.

As illustrated in FIG. 6, in the case of the structure according to an embodiment of the present invention, return loss is the smallest when the frequency is approximately 1.03 GHz. However, it can be seen that the conventional DC blocking device having an external conductor of a consistent diameter has the smallest return loss at approximately 3.45 GHz.

Thus, since the frequency having the smallest return loss is one third of that of the conventional DC blocking device, the length of the portion (b) where coupling occurs may also be shortened to about one third of its length. In other words, a DC blocking device having the structure according to the present invention may have the length of the portion where coupling occurs shortened to approximately one third of that of the conventional device, and this means that the length of the insertion groove 410 and the insertion conductor 412 may be set at approximately $\lambda/12$. In other words, if RF signals of 850 MHz-900 MHz band are used, a DC blocking device according to the present invention may have the length of the portion where coupling occurs set at approximately 14 mm.

Consequently, the structure of a DC blocking device according to an embodiment of the present invention may minimize spatial constraints that occur when being mounted in a mobile communication device.

Figure 7:
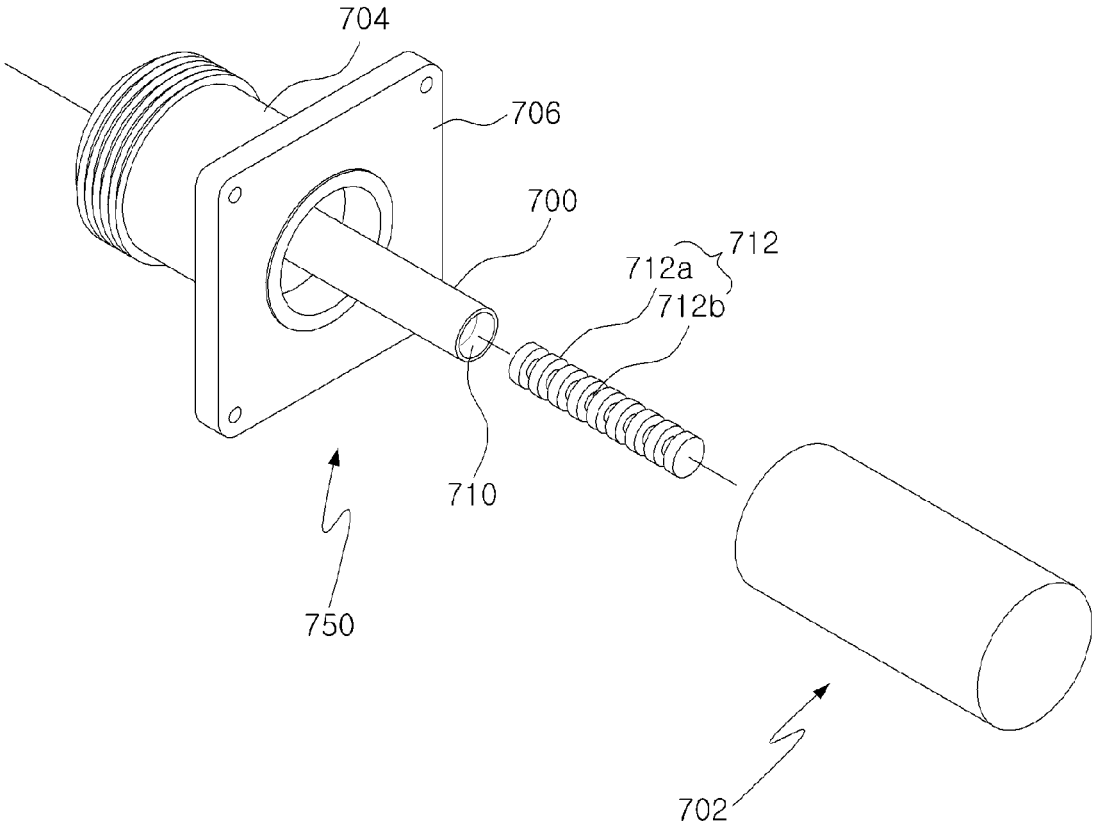
FIG. 7 is an exploded perspective view of a DC blocking device using a slow-wave structure according to an embodiment of the present invention.
Figure 8:
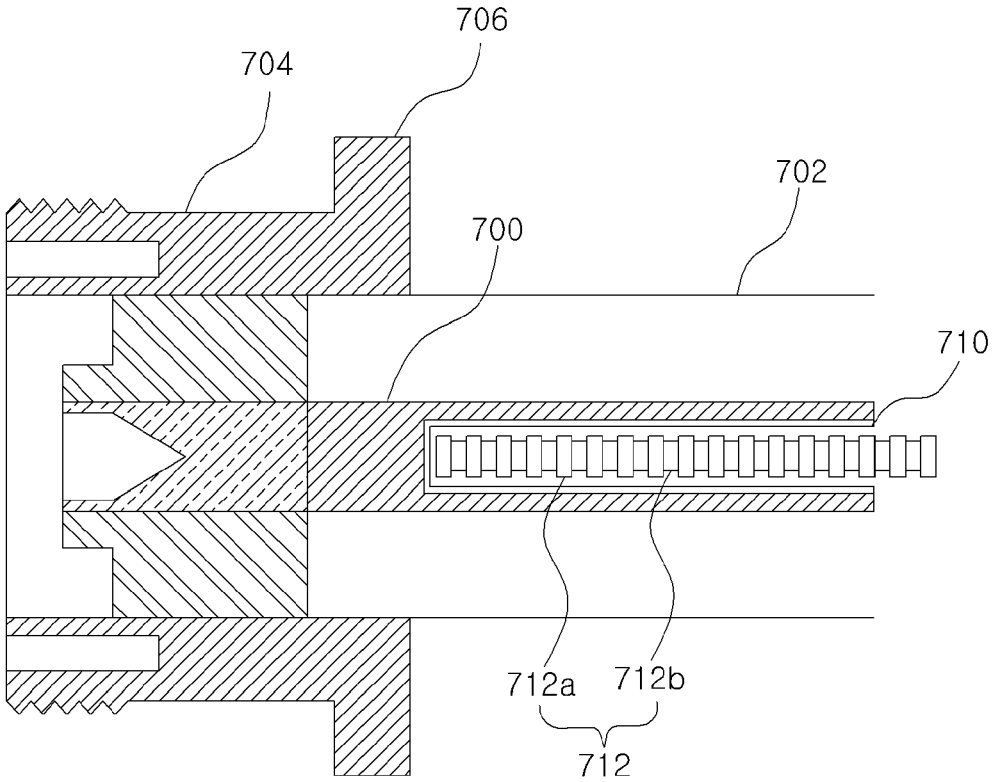
FIG. 8 is a cross-sectional view of a DC blocking device using a slow-wave structure according to an embodiment of the present invention.

FIG. 7 is an exploded perspective view of a DC blocking device using a slow-wave structure according to a second disclosed embodiment of the present invention, and FIG. 8 is a cross-sectional view of a DC blocking device using a slow-wave structure according to the second disclosed embodiment of the present invention.

The first disclosed embodiment is of a structure that attempts to make the size smaller by changing impedance, and the second disclosed embodiment is of a structure that attempts to make the size smaller by applying a slow-wave structure to an insertion conductor.

Referring to FIGS. 7 and 8, a DC blocking device according to the second disclosed embodiment of the present invention comprises: a connector unit 750, including an internal conductor 700, an external conductor 702, a connector housing 704, and a coupling board 706; and an insertion conductor 712. An insertion groove 710 is formed in the internal conductor 700.

While FIG. 7 illustrates a case in which an internal conductor 700 having signals applied thereto is the internal conductor of the connector, it will be apparent to those skilled in the art that it may just as well be an internal conductor of an ordinary transmission cable, or any other internal conductor for applying RF signals from a variety of devices.

An RF cable is coupled to the connector unit 750, and RF signals and DC signals are provided through the RF cable. As an example, an RF cable may be a coaxial cable. DC signals may be signals for supplying power to a modem mounted on a TMA or a repeater, or to other devices, and may be signals for other kinds of bias.

The internal conductor 700 and the external conductor 702 serve as a signal transmission path; RF signals and DC signals are applied to the internal conductor 700, and the external conductor 702 provides ground potential. The internal conductor 700 and external conductor 702 may be cylindrical in shape.

Although not shown in FIG. 7, an inductor (not shown) may be coupled to the entry part of the internal conductor 700 to transmit DC signals to a separate path. For example, if DC signals are power signals of a specific device, an inductor may be coupled to the internal conductor 700, providing DC power signals to the corresponding device through the inductor. In the case of blocking only the unwanted DC bias, the structure as in FIG. 7 may be employed.

An insertion conductor 712 is inserted into the insertion groove 710 of the internal conductor. The insertion conductor 712 is electrically connected to an RF signal output end (not shown).

As illustrated in FIGS. 7 and 8, the insertion conductor 712 is inserted with a designated distance of space left between it and the internal conductor 700. The space between the insertion conductor 712 and the internal conductor may be filled with a dielectric. Alternatively, air may perform the function of dielectric. When a dielectric is filled into it, a person skilled in the art would understand that a dielectric made of Teflon or of other materials may also be used.

An electromagnetic coupling occurs between the internal conductor 700 and the insertion conductor 712, and the RF signals applied at the internal conductor 700 are coupled from the internal conductor 700 to the insertion conductor 712 and outputted. In other words, RF signals applied at the internal conductor 700 is coupled to the insertion conductor 712, but DC signals are not coupled but are blocked.

According to a preferred embodiment of the present invention, the insertion conductor 712 where coupling occurs is of a slow-wave structure. A slow-wave structure is one in which a periodical pattern is repeated, and is for controlling the speed of signals in a transmission cable; such a slow-wave structure is applied to the insertion conductor 712 of the present invention.

As illustrated in FIGS. 7 and 8, the insertion conductor 712 has a structure in which protrusions 712*a* and grooves 712*b* are periodically repeated. While FIGS. 7 and 8 illustrate a structure in which protrusions having rectangular cross sections are periodically repeated, it will be apparent to those skilled in the art would that the shape of protrusions may be set in various ways. For example, protrusions having triangular cross sections may also be implemented, causing the cross section of the insertion conductor to have a saw-tooth form.

In this manner, having an insertion conductor 712 of a slow-wave structure is for implementing the length of the insertion conductor in a smaller size. As described above, the length of the portion where coupling between the internal conductor 700 and the insertion conductor 712 occurs should be set as $\lambda/2$, that is, half of the central frequency wavelength $\lambda$. For example, if RF signals of 850 MHz-900 MHz band are used, the length of the portion where coupling occurs should be set at approximately 42 mm, but if a slow-wave structure according to an embodiment of the present invention is used, the insertion conductor can be implemented at an even shorter length.

In a slow-wave structure such as in FIG. 7, the greater the difference between the diameter of a protrusion and that of a groove is, and the greater the number of repetitions between the protrusions and grooves is, the lower the frequency band of coupling gets.

In other words, when a slow-wave structure according to an embodiment of the present invention is applied to the insertion conductor 712, even if the length of the insertion conductor is shortened within the same band, appropriate DC blocking and RF signal coupling may be achieved.

Figure 9:
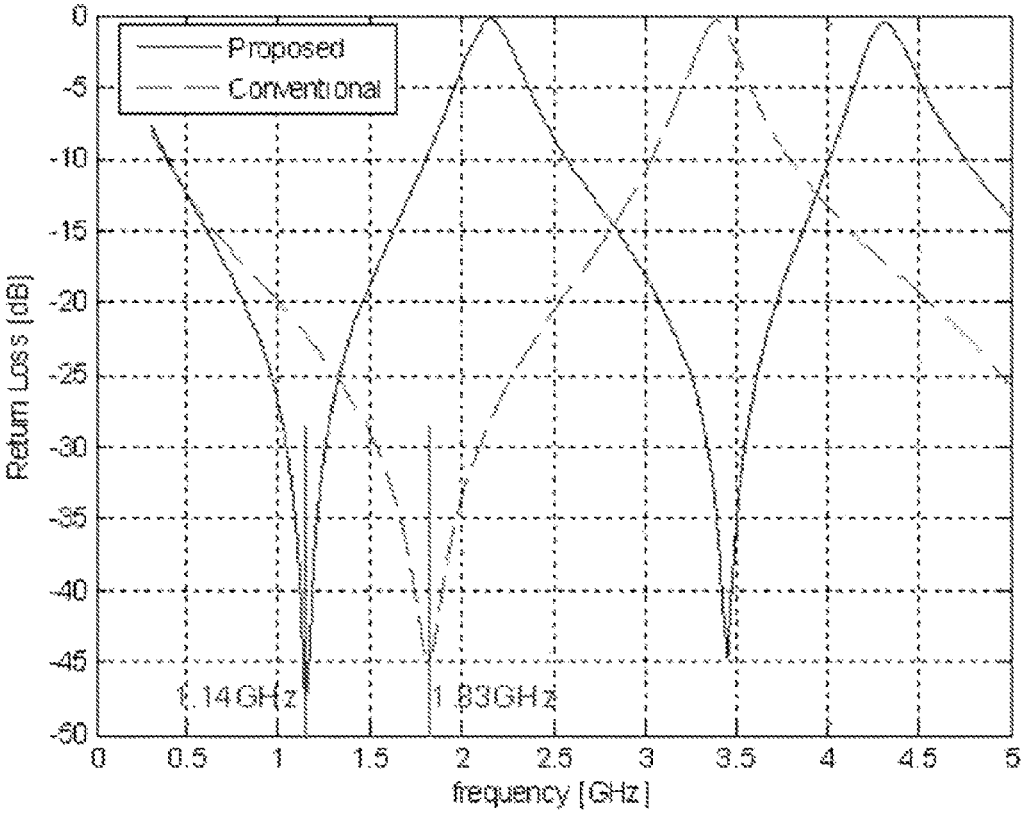
FIG. 9 is a drawing illustrating reflection loss when an insertion conductor of an ordinary line type is used, and reflection loss when an insertion conductor of a slow-wave structure according to the present invention is used.

FIG. 9 is a drawing illustrating reflection loss when an insertion conductor of an ordinary line type is used, and reflection loss when an insertion conductor of a slow-wave structure according to the present invention is used.

In FIG. 9, the insertion conductor of a slow-wave structure has protrusions of 2.9 mm diameter and grooves of 1 mm diameter, and the number of protrusions and grooves is set to be twenty-seven. When comparing reflection loss, it can be seen that a zero point is formed at approximately 1.14 GHz if an insertion conductor of a slow-wave structure is used, but a zero point is formed at approximately 1.83 GHz if an insertion conductor of an ordinary line type is used.

While the spirit of the invention has been described in detail with reference to particular preferred embodiments, it is to be appreciated that those skilled in the art can change or modify the embodiments without departing from the scope and spirit of the invention as set forth in the claims below.

The invention claimed is:

1. A DC blocking device of a small size comprising:

an internal conductor configured to receive an RF signal applied thereto; and an external conductor electrically connected to a ground;

wherein the internal conductor has an insertion groove formed therein, the DC blocking device further comprises an insertion conductor configured to be inserted into the insertion groove without touching the internal conductor and at a designated distance, and a diameter of the external conductor in a portion where the insertion conductor is inserted is set to be larger than in another portion.

2. The DC blocking device of a small size according to claim 1, wherein the internal conductor has a junction groove formed therein for coupling an inductor.

3. The DC blocking device of a small size according to claim 1, wherein a change in reactance in the another portion where the diameter of the external conductor is set smaller causes a decrease in an optimal coupling frequency.

4. A DC blocking device using a slow-wave structure comprising:

an internal conductor configured to receive an RF signal applied thereto and having a groove formed therein;

an external conductor electrically connected to a ground; and an insertion conductor inserted into the groove of the internal conductor and electrically separated from the internal conductor, wherein the insertion conductor is of a structure having repeated protrusions and grooves.

5. The DC blocking device according to claim 4, wherein a cross section of the protrusions is rectangular.

6. The DC blocking device according to claim 4, wherein coupling is achieved from the internal conductor to the insertion conductor, and a coupling frequency is determined by a difference in size between the protrusions and grooves and by a number of the repeated protrusions and grooves.

7. The DC blocking device according to claim 6, wherein an inductor is coupled to the internal conductor, and if a DC signal and an RF signal are applied to the internal conductor, the DC signal is provided to a path having the inductor coupled thereto and the RF signal is coupled from the internal conductor to the insertion conductor.

* * * * *